United States Patent [19]

Strasser

[11] Patent Number: 4,631,759

[45] Date of Patent: Dec. 30, 1986

[54] BASE HAVING REMOVABLE SIDE RAILS FOR ELEVATING A TOILET

[76] Inventor: Thaddeus B. Strasser, 613 Pierce St., Sandusky, Ohio 44870

[21] Appl. No.: 633,628

[22] Filed: Jul. 23, 1984

[51] Int. Cl.[4] ..... E03D 11/00

[52] U.S. Cl. ..... 4/252 R; 4/661; 4/254; 285/22; 285/56; 285/58

[58] Field of Search ..... 4/252 R, 420, 254, 661, 4/251, 316, 237, 328, 345; 285/19, 22, 56, 58, 59, 60

[56] References Cited

U.S. PATENT DOCUMENTS

| | | | |
|---|---|---|---|
| 102,738 | 3/1870 | Wellington | 4/420 |
| D. 255,481 | 6/1980 | Moore | 4/252 R X |
| 331,610 | 12/1885 | Bunting, Jr. | 4/328 |
| 340,287 | 4/1886 | Clifford | 4/420 |
| 851,679 | 4/1907 | Lloyd | 4/237 X |
| 2,673,985 | 4/1954 | Gay | 4/252 R |
| 3,010,115 | 11/1961 | Wiggs | 4/300 |
| 3,323,144 | 6/1967 | Ferris, Jr. | 4/254 |
| 3,360,805 | 1/1968 | Aumann | 4/252 R |
| 3,405,411 | 10/1968 | Brown | 4/254 |
| 3,457,571 | 7/1969 | Harbake | 285/58 X |
| 3,473,174 | 10/1969 | Cool | 4/251 |
| 3,474,471 | 10/1969 | Matibag | 4/254 |
| 3,619,820 | 11/1971 | Cain et al. | 4/254 |
| 3,896,510 | 7/1975 | O'Connell | 4/252 R |
| 4,012,797 | 3/1977 | Kristoffersen | 4/252 R |
| 4,014,053 | 3/1977 | Jones | 4/252 R |
| 4,041,554 | 8/1977 | Gregory et al. | 4/316 X |
| 4,052,756 | 10/1977 | Whiteman, Sr. et al. | 4/345 |
| 4,091,473 | 5/1978 | Matthews et al. | 4/420 |
| 4,174,546 | 11/1979 | Ohtake | 4/420 |

*Primary Examiner*—Henry K. Artis

*Attorney, Agent, or Firm*—Willian, Brinks, Olds, Hofer, Gilson & Lione

[57] ABSTRACT

A base having removable side rails for elevating a toilet for use by physically handicapped or elderly persons is disclosed. The base is formed generally in the shape of a flat rectangle having a height equal to the amount by which it is desired to elevate the toilet above a floor for use. A large aperture is formed through the base near the central portion thereof having appropriate plumbing fittings for connecting the bowl of the toilet to the drain. A first pair of smaller apertures are provided to permit the passage therethrough of appropriate threaded fasteners so as to secure the toilet to the floor. A second pair of apertures are formed through the sides of the base to permit appropriate side rails to be inserted therein for use. Each of the side rails includes an adjustable grip which can be positioned and secured in a desired manner so as to assist a person in getting on and off of the toilet seat.

8 Claims, 5 Drawing Figures

BASE HAVING REMOVABLE SIDE RAILS FOR ELEVATING A TOILET

BACKGROUND OF THE INVENTION

1. Field Of The Invention

The present invention relates in general to toilets and in particular to a base having removable side rails for elevating a toilet.

In the past, toilets or water closets have typically been formed of a fixed height, stool-type construction. Such a construction often causes difficulties to persons who have difficulty in controlling their movements, such as those who are physically handicapped or elderly, and who must be lowered a relatively long distance onto the toilet seat. It is known in the art to form the toilet with an enlarged bowl support member, thus disposing the toilet seat at a higher height than normal in order to reduce the distance through which the person must be lowered. It is further known to provide handrails on the enclosing walls of the toilet to aid a person in the process of getting on and off the toilet seat. However, both such structures are permanent and not easily removable, and are typically very expensive. Prior to the present invention, no structure was known for readily adapting a conventional toilet for convenient use by physically handicapped or elderly persons.

2. Description Of The Prior Art

Various toilet and water closet constructions are described and illustrated in U.S. Pat. Nos. 102,738 to Wellington, 331,610 to Bunting, Jr., 340,287 to Clifford, 851,679 to Lloyd, 3,010,115 to Wiggs, 4,041,554 to Gregory et al., 4,052,756 to Whiteman, Sr. et al, 4,091,473 to Matthews et al., and 4,174,546 to Ohtake.

SUMMARY OF THE INVENTION

The present invention relates to a base having removable side rails for elevating a toilet for use by physically handicapped or elderly persons. The base is formed generally in the shape of a flat rectangle having a height equal to the amount by which it is desired to elevate the toilet above a floor for use. A large aperture is formed through the base near the central portion thereof having appropriate plumbing fittings for connecting the bowl of the toilet to the drain. A first pair of smaller apertures are provided to permit the passage therethrough of appropriate threaded fasteners so as to secure the toilet to the floor. A second pair of apertures are formed through the sides of the base to permit appropriate side rails to be inserted therein for use. Each of the side rails includes an adjustable grip which can be positioned and secured in a desired manner so as to assist a person in getting on and off of the toilet seat.

It is an object of the present invention to provide a base for elevating a toilet so as to assist handicapped persons in their use of the toilet.

It is another object of the present invention to provide such a base having removable side rails.

It is a further object of the present invention to provide such an apparatus for aiding physically handicapped or elderly persons which is simple and inexpensive in construction.

Other objects and advantages of the present invention will become apparent to those skilled in the art from the following detailed description of the preferred embodiment, when read in light of the accompanying drawings.

DETAILED DESCRIPTION OF THE PREFERRED EMBODIMENT

Figure 4:
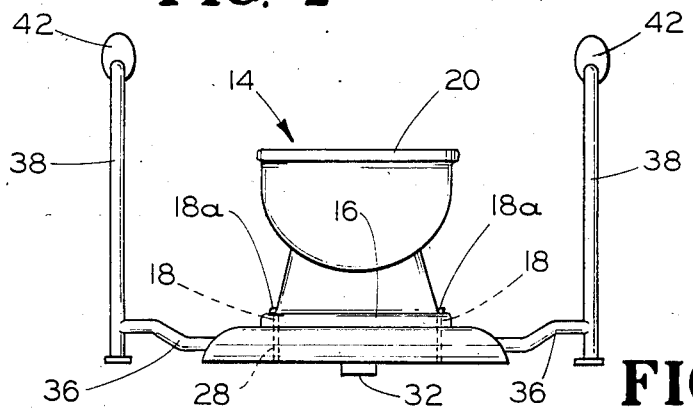
FIG. 4 is a front elevational view of the base and side rails illustrated in FIG. 1 shown in an assembled configuration.

Referring now to the drawings, there is illustrated a base 10 having a pair of opposed removable side rails 12 for elevating a toilet 14 above a floor (not shown). The toilet 14 includes a bottom portion 16 having a pair of apertures 18 formed therein. A pair of "T" bolts or other fasteners 18*a* (FIG. 4) can be inserted through the apertures 18 into engagement with a closet flange (not shown) fastened to the floor beneath the toilet 14 and the base 10 so as to secure the toilet 14 thereto. The toilet 14 can be any standard fixed height water closet. By fixed height, it is understood that a seat portion 20 of the toilet 14 is fixed at a standard height above the floor, typically about fifteen inches. Such height is generally accepted as being convenient for use by most persons. However, physically handicapped or elderly persons often find it more convenient to utilize a toilet wherein the seat portion 20 is disposed three inches or more above this standard height.

Figure 1:
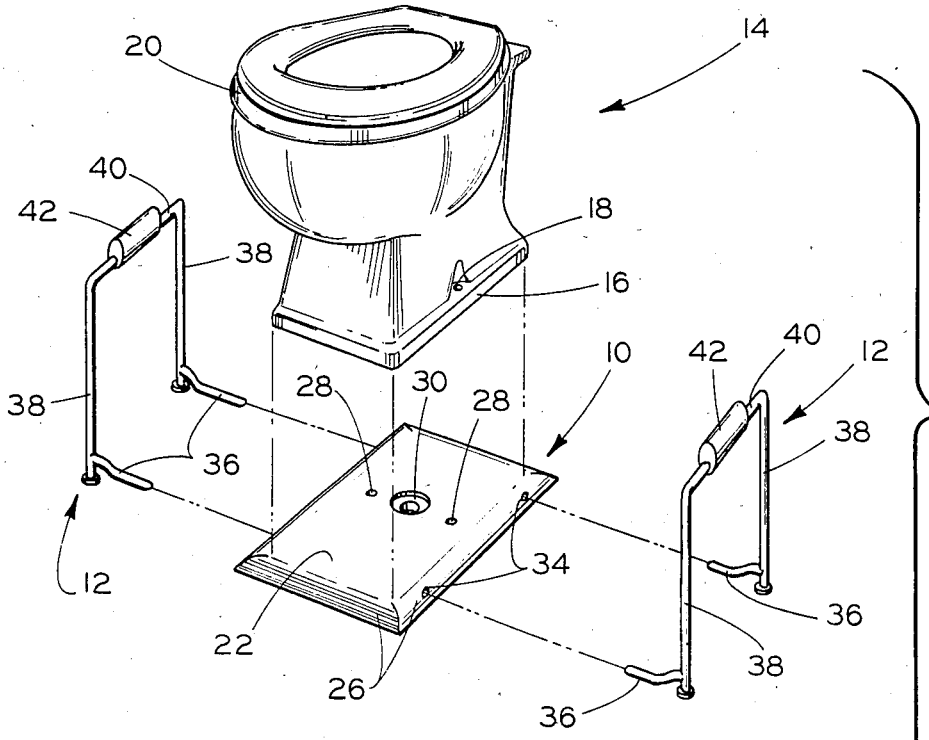
FIG. 1 is an exploded perspective view of the base and removable side rails for elevating a toilet in accordance with the present invention.
Figure 2:
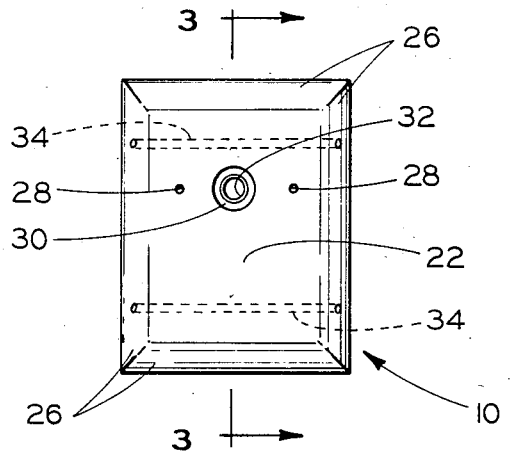
FIG. 2 is a top plan view of the base illustrated in FIG. 1.
Figure 3:
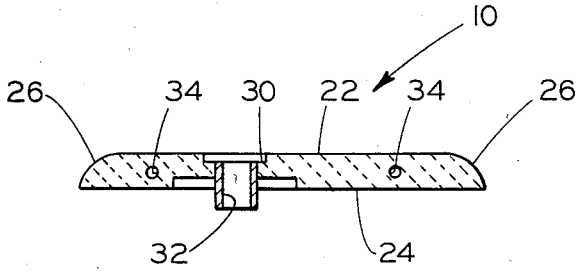
FIG. 3 is a sectional elevational view taken along line 3—3 of FIG. 2.

The base 10 includes a generally flat top portion 22, a generally flat bottom portion 24 (FIG. 3), and curved side portions 26 on each of its sides to provide a smooth and aesthetically-pleasing appearance. The base 10 can be formed of any material which is sturdy enough to support the toilet 14, such as fiberglass or die formed fiberglass. A pair of apertures 28 are formed in the base 10 extending between the top portion 22 and the bottom portion 24. The apertures 28 are adapted to be aligned co-axially with the apertures 18 formed in the bottom portion 16 of the toilet 14 such that the "T" bolt head fasteners 18*a* can be fastened to the floor flange in the floor. A relatively large aperture 30 is formed in the central portion of the base 10 extending through the top portion 22 to the bottom portion 24. A plumbing fitting 32 is secured within the aperture 30 so as to connect a drain pipe (not shown) of the toilet 14 to the floor flange fastened to the floor. The aperture 30 can be enlarged somewhat at the surfaces of both the top portion 22 and the bottom portion 24 to mate with the existing plumbing fittings in both the toilet 14 and the floor.

A pair of channels 34 are formed in the base 10 extending between two of the opposed side portions 26 of the base 10. Although the channels 34 are illustrated as extending completely through the base 10, it will be appreciated that such channels 34 can be formed as extending only partially through the base 10 on each of the opposed side portions 26 thereof. The channels 34 are adapted to receive respective horizontally-extending leg members 36 of each of the side rails 12. Each of the side rails 12 further includes a vertically-extending support member 38 connected to each leg member 36 and a horizontally-extending handrail portion 40 connected between the pair of support members 38. The leg portions 36 of the side rails 12 are adapted to be inserted in the respective channels 34 formed in the base 10 when it is desired to provide handrails to assist a person in getting on or off of the toilet seat 20.

Figure 5:
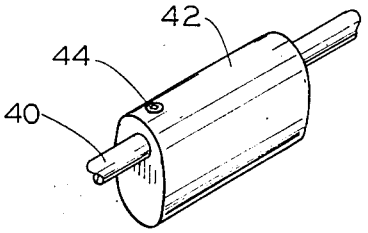
FIG. 5 is a close-up perspective view of the hand grip portion of one side rail illustrated in FIG. 1.

If desired, an adjustable hand grip 42 can be attached to each of the handrail portions 40 to assist the person in maintaining a firm hold on each of the side rails 12. As shown most clearly in FIG. 5, the hand grip 42 can be formed in the shape of a right cylinder having an oval-shaped cross section. The hand grip 42 can be rotatably mounted eccentrically about the handrail portion 40. By rotating the hand grip 42, the angle and effective height thereof can be varied with respect to the toilet seat 20 to suit the needs of the particular individual. A recessed threaded fastener 44 or other means can be utilized to secure the hand grip 42 in a desired position relative to the side rail 12.

It will be appreciated that the present invention provides a simple and inexpensive means for adapting a conventional toilet 14 for use by persons who have difficulty in controlling their movements. As mentioned above, such persons often find it difficult to lower themselves onto or raise themselves off of a conventional toilet 14 because the seat 20 thereof is disposed at a standard height which is too low for convenient use. By utilizing a base 10 in accordance with the present invention, the toilet 14 can be raised such that the seat 20 is disposed at a more manageable height. If additional assistance is required, the side rails 12 can be inserted in the channels 34 of the base 10 to provide handrails 40 and hand grips 42 for use, requiring no drilling or damage to the existing floor or wall coverings. Although the base 10 and side rails 12 can be installed and utilized for an indefinite period of time, it can be seen that the present invention is not permanent in nature. Thus, it can be installed and removed readily as desired. Also, it is much more inexpensive than to utilize the present invention than to purchase and install enlarged toilet bowl constructions which are designed for use by physically handicapped or elderly persons.

In accordance with the provisions of the patent statutes, the principle and mode of operation of the present invention has been explained and illustrated in its preferred embodiments. However, it must be appreciated that the present invention can be practiced otherwise than as specifically explained and illustrated without departing from its spirit or scope.

What is claimed is:

1. An apparatus for elevating a toilet by a predetermined amount above a floor having a drain comprising a base having a height equal to the amount by which it is desired to elevate the toilet above the floor, the base having an aperture formed therein for connecting the toilet to the drain, and at least one side rail removably secured to said base, said side rail including two horizontally-extending leg members adapted to be received in respective channels formed in said base, a vertically-extending support member connected to each of said leg members, and a horizontally-extending handrail portion connected between said support members.

2. The invention defined in claim 1 wherein said base is formed having a generally flat top portion, a generally flat bottom portion, and curved side portions on each of its sides.

3. The invention defined in claim 2 wherein said base is formed generally in the shape of a flat rectangle.

4. The invention defined in claim 1 wherein said side rail further includes an adjustable hand grip mounted on said handrail portion.

5. The invention defined in claim 4 wherein said adjustable hand grip is formed in the shape of a right cylinder having an oval-shaped cross section.

6. The invention defined in claim 5 wherein said hand grip is mounted eccentrically about said handrail portion.

7. The invention defined in claim 6 further including means for securing said hand grip in a desired position relative to said handrail portion.

8. A base for elevating a toilet having a drain pipe to a predetermined height above a floor having a drain comprising:

a bottom portion adapted to engage the floor, said bottom portion having a recessed area formed therein to receive the drain;

a generally flat top portion adapted to support the toilet thereon, said top portion having a recessed area formed therein to receive the drain pipe of the toilet;

an aperture formed through said base from said top portion recessed area to said bottom portion recessed area for connecting the drain pipe of the toilet to the drain; and at least one side rail removably secured to said base, said side rail including two leg members adapted to be received in respective channels formed in said base for removably securing said side rail to said base.

* * * * *